US006157357A

United States Patent [19]

Kim

[11] Patent Number: 6,157,357

[45] **Date of Patent: *Dec. 5, 2000**

[54] LIQUID CRYSTAL PANEL WITH BYPASS CAPACITOR THEREON

[75] Inventor: Jin Kyu Kim, Kyunggi-Do, Rep. of Korea

[73] Assignee: LG Philips LCD Co., Ltd., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 09/112,968

[22] Filed: Jul. 9, 1998

[30] Foreign Application Priority Data

Sep. 23, 1997 [KR] Rep. of Korea ..... P97-48261

[51] Int. Cl.[7] ..... G09G 3/36

[52] U.S. Cl. ..... 345/87; 349/38; 349/39; 349/143; 349/147; 349/139

[58] Field of Search ..... 345/87, 90, 92, 345/58, 211, 205–206, 204, 98, 100; 349/139–143, 49, 151, 54, 38–39, 42–43, 147, 149–152; 257/786, 729; 439/67; 361/780

[56] References Cited

U.S. PATENT DOCUMENTS

| | | | |
|---|---|---|---|
| 5,600,461 | 2/1997 | Ueda et al. | 349/38 |
| 5,912,809 | 6/1999 | Steigerwald et al. | 361/780 |
| 5,967,799 | 10/1999 | Arai | 439/67 |

*Primary Examiner*—Richard A. Hjerpe
*Assistant Examiner*—Francis Nguyen

[57] ABSTRACT

A liquid crystal panel includes bypass capacitors for removing a noise and a ripple from signals applied thereto. The liquid crystal panel is provided with a liquid crystal cell matrix having thin film transistors and liquid crystal cells arranged in a matrix pattern and located between the first and second glass substrates, and signal lines arranged on any one of the first and second glass substrates to receive signals from an exterior thereof. The bypass capacitors are formed and located in the lower portion of the signal lines and so as to be electrically connected to the signal lines. The bypass capacitors remove noise components included in the signals to be transferred through the signal lines.

21 Claims, 6 Drawing Sheets

LIQUID CRYSTAL PANEL WITH BYPASS CAPACITOR THEREON

BACKGROUND OF THE INVENTION

1. Field of the Invention

The present invention relates to a liquid crystal display device, and more particularly, to a liquid crystal panel including bypass capacitors for eliminating noise and ripple from signals.

2. Description of the Prior Art

Generally, a liquid crystal display (LCD) controls a light transmissivity of liquid crystal cells in accordance with a video signal, thereby displaying a picture corresponding to the video signal on the liquid crystal panel in which liquid crystal cells are arranged in a matrix pattern. The LCD includes driving integrated circuits(ICs) for driving the liquid crystal cell matrix in the liquid crystal panel, and an electrical signal converting circuit for driving video signals, timing signals and power supply voltage signals to be supplied for the driving ICs. Typically, the driving ICs are manufactured to be an IC chip and the electrical signal converting circuit is manufactured to be a printed circuit board(PCB).

The driving IC chips are electrically connected to a liquid crystal cell matrix in the liquid crystal panel via a conductive film tab. At this time, the driving IC chips are mounted on either the conductive film tab or the surface of the liquid crystal panel. The LCD may be classified as a tab system LCD and a surface mounted system LCD, which is called "Chips On Glass" (COG), in accordance with a position where the driving IC chips are disposed. Further, the PCB is electrically connected to the driving IC chips via a flexible printed circuit film, hereinafter referred simply to as "FPC".

In the LCD, the video signals, the timing signals and the power supply voltage signals to be supplied from the electrical signal converting circuit, via the FPC, to the driving ICs are influenced by a noise and a ripple, and other harmful effects during the transfer of the signals to the driving ICs. In order to minimize the influence caused by the noise and the ripple and other harmful effects, the LCD further comprises bypass capacitors. These bypass capacitors can improve a quality of the picture displayed on the liquid crystal panel by removing a noise and a ripple and other harmful effects from the video signals, the timing signals and the power supply voltage signals.

A conventional LCD constructed in this way is shown in FIG. 1 and includes a liquid crystal panel 10 in which a liquid crystal cell matrix is defined, source driving IC chips 14 for divisionally driving source lines of the liquid crystal cell matrix 12, and gate driving IC chips 16 for divisionally driving gate lines of the liquid crystal cell matrix 12. The source driving IC chips 14 are located along the upper edge of the liquid crystal panel 10 while the gate driving IC chips 16 are located along the left edge of the liquid crystal panel 10. The liquid crystal cell matrix 12 is typically formed to include thin film transistors(TFTs) located between a lower glass substrate and an upper glass substrate (not shown). Further, the LCD includes a PCB 18 for supplying the source driving IC chips 14 and the gate driving IC chips 16 with the video signal, the timing signal and the power supply voltage, and a FPC 20 for electrically connecting the PCB 18 to the source driving IC chips 14 and the gate driving IC chips 16.

The FPC 20 is provided with bypass capacitors 22 which improve a quality of picture produced on the LCD by removing a noise and a ripple and other harmful effects from the video signals, the timing signals and the power supply voltage signals to be transferred into the source driving ICs 14 and the gate driving ICs 16.

Alternatively, the bypass capacitors 22 may be provided on the PCB 18. The PCB 18 is implemented with an electrical signal converting circuit that generates the video signals, the timing signals and the power supply voltage signals to be supplied for the source driving IC chips 14 and the gate driving IC chips 16.

In the conventional LCD, because the FPC is directly connected to the driving IC chips as described above, the FPC has a very complicated configuration. Also, in the conventional LCD, because the bypass capacitors are provided in the FPC or the PCB, the liquid crystal panel module has a considerable thickness.

A so-called "lines on glass(LOG)" system for an LCD, which system simplifies the structure and the manufacturing process of the FPC by providing a part of the wiring in the FPC on the liquid crystal panel, is now commercially available in the market. This LOG system type of LCD simplifies the structure and the manufacturing process and also reduces the manufacturing cost of the FPC and the LCD. In the LOG system type of LCD, however, it is difficult to make a liquid crystal panel module sufficiently thin because the bypass capacitors are provided in the FPC or in the PCB.

In order to provide the significantly thin liquid crystal panel module, a process for mounting the bypass capacitors on the liquid crystal panel was disclosed in a Japanese Laid-open Patent Gazette No. 7-128678. In JP 7-128678, the bypass capacitors were provided by charging a dielectric material between the liquid crystal panel and the driving IC chips. This process has a disadvantage in that, since the charge of the dielectric material requires a certain amount of space between the liquid crystal panel and the driving IC chips, it is not only impossible to provide a reduced thickness of the liquid crystal panel module beyond a specific limit, but also a wiring pattern and a process for forming the same, which pattern is to be arranged on the liquid crystal panel, becomes complicated. Further, the above process has a disadvantage in that the charge of dielectric material requires an additional manufacturing process after the manufacture of the liquid crystal panel, specifically, after the manufacture of the thin film transistors.

SUMMARY OF THE INVENTION

The preferred embodiments of the present invention overcome the problems described above by providing a liquid crystal panel including bypass capacitors and also having a significantly reduced thickness.

The preferred embodiments of the present invention also provide a liquid crystal panel including bypass capacitors and a manufacturing method thereof which stabilizes a power supply voltage.

Further, the preferred embodiments of the present invention provide a liquid crystal display apparatus which has a significantly reduced thickness and greatly improved quality of displayed pictures.

According to one preferred embodiment of the present invention, a liquid crystal display apparatus or a liquid crystal panel includes a first glass substrate defining an upper substrate, a second glass substrate defining a lower substrate, a liquid crystal cell matrix having thin film transistors and liquid crystal cells between the upper substrate and the lower substrate, a plurality of signal lines provided on one of the first and second glass substrates for receiving signals from an exterior thereof and for transferring the signals to the liquid crystal cell matrix, and at least one bypass capacitor arranged to remove noise components included in signals to be transferred through each of the signal lines, the at least one bypass capacitor being located on an upper surface of the lower substrate and arranged to overlap at least one of the signal lines such that the at least one bypass capacitor is electrically connected to the at least one of said signal lines, the at least one bypass capacitor overlapping the at least one of said signal lines at a location that is spaced from a flexible printer circuit film.

In another preferred embodiment, a liquid crystal display apparatus or a liquid crystal panel includes a first glass substrate defining an upper substrate, a second glass substrate defining a lower substrate, a liquid crystal cell matrix having thin film transistors and liquid crystal cells between the upper substrate and the lower substrate, a plurality of signal lines provided on one of the first and second glass substrates for receiving signals from an exterior thereof and for transferring the signals to the liquid crystal cell matrix, and at least one bypass capacitor arranged to remove noise components included in signals to be transferred through each of the signal lines, the at least one bypass capacitor being located between an upper surface of the lower substrate and the signal lines at a location that is spaced from a flexible printer circuit film such that the at least one bypass capacitor is electrically connected to at least one of the signal lines.

A plurality of bypass capacitors may be provided in the liquid crystal panel or apparatus such that each of the plurality of bypass capacitors overlap one of the signal lines at a location that is spaced from a flexible printer circuit film.

Also, the liquid crystal panel or apparatus may include a plurality of driving IC chips provided on the upper surface of the lower substrate and arranged such that the at least one bypass capacitor overlaps the signal lines at a location between adjacent ones of the driving IC chips. The driving IC chips preferably include gate driving IC chips and source driving IC chips which are arranged such that each of the plurality of bypass capacitors mentioned above overlap the signal lines at locations that are between adjacent ones of the gate driving IC chips and source driving IC chips and that are spaced from the flexible printer circuit film.

In another preferred embodiment, the liquid crystal panel or apparatus may also include a plurality of electrode pads arranged to define a capacitor and located on the upper surface of said lower substrate and electrically connected to one of the signal lines and a plurality of bypass capacitors connected to one of the electrode pads for removing noise components included in the signals to be transferred through each of the signal lines.

Other features and advantages of the present invention will become apparent from the following description of preferred embodiments of the invention which refers to the accompanying drawings, wherein like reference numerals indicate like elements to avoid duplicative description.

DETAILED DESCRIPTION OF PREFERRED EMBODIMENTS

Figure 1:
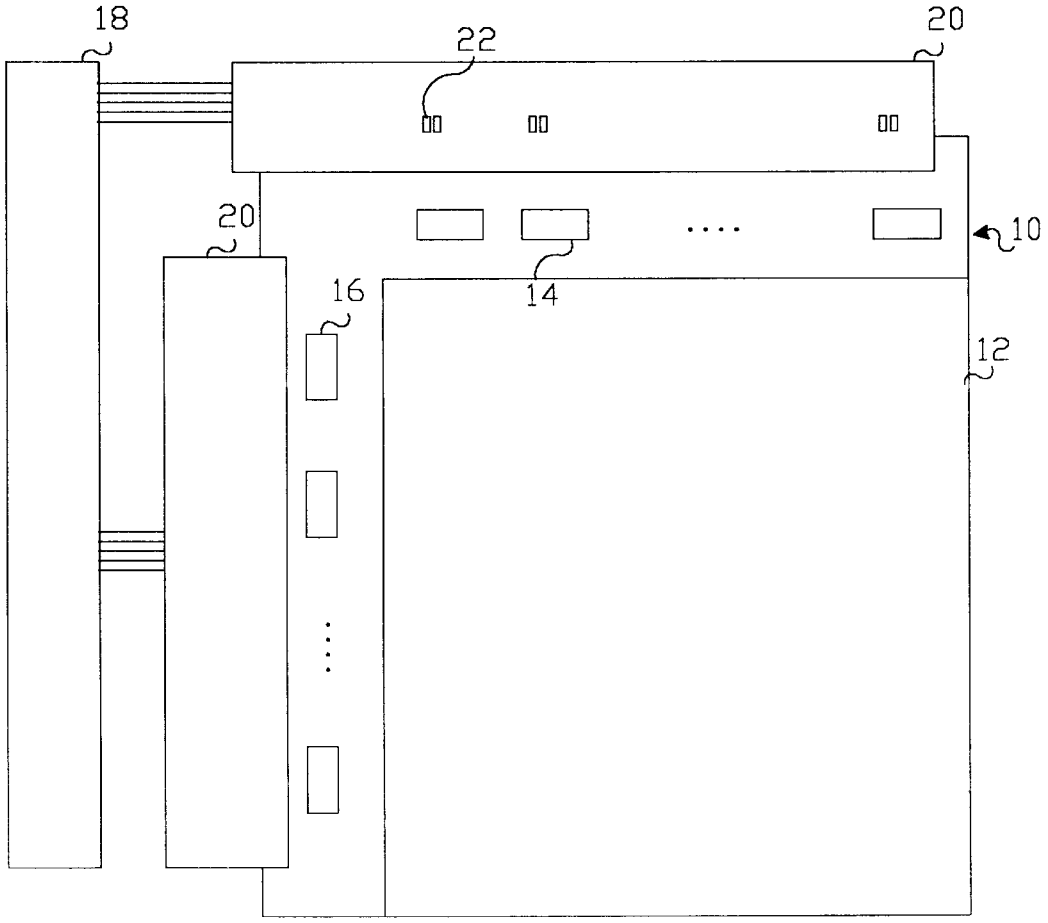
FIG.1 PRIOR ART
FIG. 1 is a schematic diagram showing a configuration of a conventional liquid crystal display apparatus.
Figure 2:
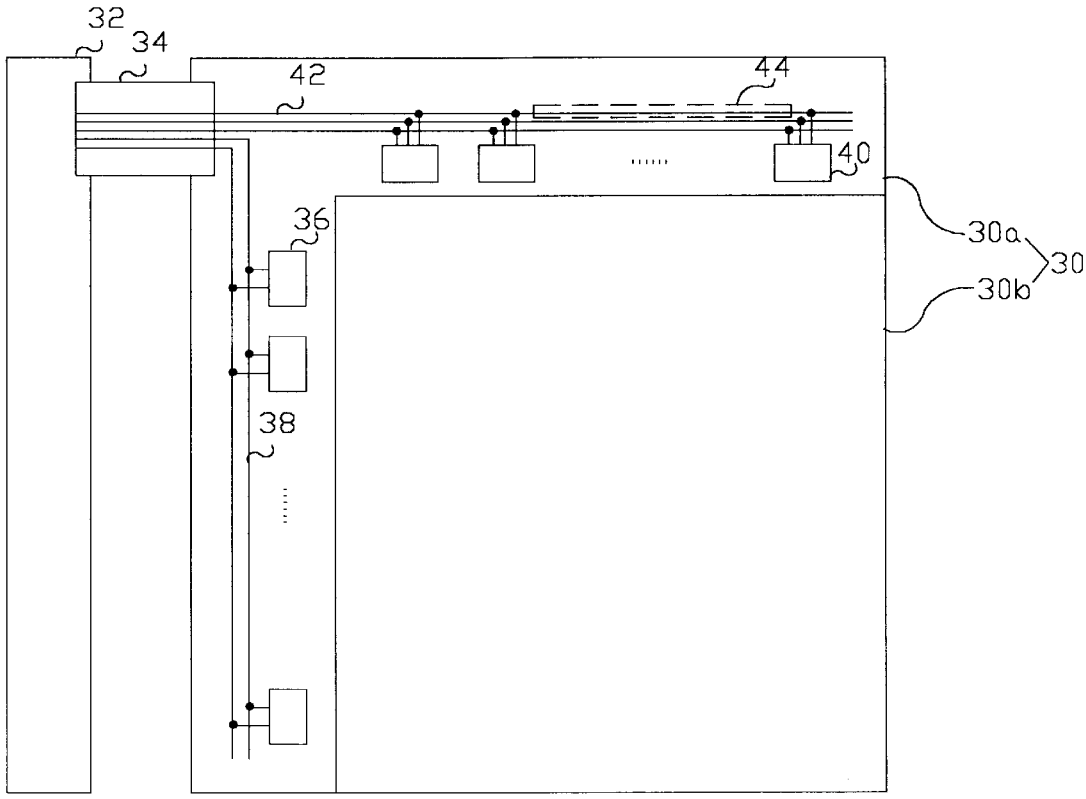
FIG. 2 is a schematic diagram showing a configuration of a liquid crystal display apparatus that incorporates a liquid crystal panel having bypass capacitors according to a first preferred embodiment of the present invention.

Referring to FIG. 2, there is shown an LCD that incorporates a liquid crystal panel including bypass capacitors arranged according to the first preferred embodiment of the present invention. In FIG. 2, the LCD includes a liquid crystal panel 30 that is electrically connected to a PCB 32 via a FPC 34. This liquid crystal panel 30 includes a lower glass substrate 30*a* and an upper glass substrate 30*b*. A liquid crystal cell matrix (not shown) in which liquid crystal cells are arranged along with thin film transistor in a matrix arrangement, is provided between the glass substrates 30*a* and 30*b*. Gate driving IC chips 36 for divisionally driving gate lines of the liquid crystal cell matrix and a first signal wiring 38 for applying timing signals to the gate driving IC chips 36 are disposed on the left side edge of the lower glass substrate 30*a*. Source driving IC chips 40 for divisionally driving source lines of the liquid crystal cell matrix and a second signal wiring 42 for applying video signals and timing signals to the source driving chips 40 are disposed on the upper edge of the lower glass substrate 30*a*. The first and second signal wirings 38 and 42 are electrically connected to the FPC 34 via connectors to thereby receive the video signals and the timing signals via the FPC 34 from the PCB 32.

Further, bypass capacitors 44 are provided and located in the upper edge of the lower glass substrate 30*a* so as to be overlapped with the second signal wiring 42. The bypass capacitors 44 are connected to signal lines of the second signal wiring 42, respectively, thereby removing a noise and a ripple and other harmful effects included in the timing signals and the video signals being transmitted through the second signal wiring 42. The bypass capacitors 44 and the first and second signal wirings 38 and 42 are preferably formed all together when thin film transistors are formed on the lower glass substrate 30*a*.

Furthermore, an electrical signal modulating circuit for generating video signals, timing signals and power supply voltage signals is provided in the PCB 32. This electrical signal modulating circuit is electrically connected to the FPC 34 via connectors to supply the first and/or second signal wiring 38 and 42 with the video signals, the timing signals and the power supply voltage signals. On the other hand, the FPC 34 is responsible for connecting the PCB 32 implemented with the electrical signal modulating circuit to the first and second signal wirings 38 and 42 merely, so that it has a very simplified configuration. In other words, since the first and second signal wirings 38 and 42 perform part of the function of the conventional FPC, the configuration of the FPC 34 in FIG. 2 can be simplified.

Figure 3:
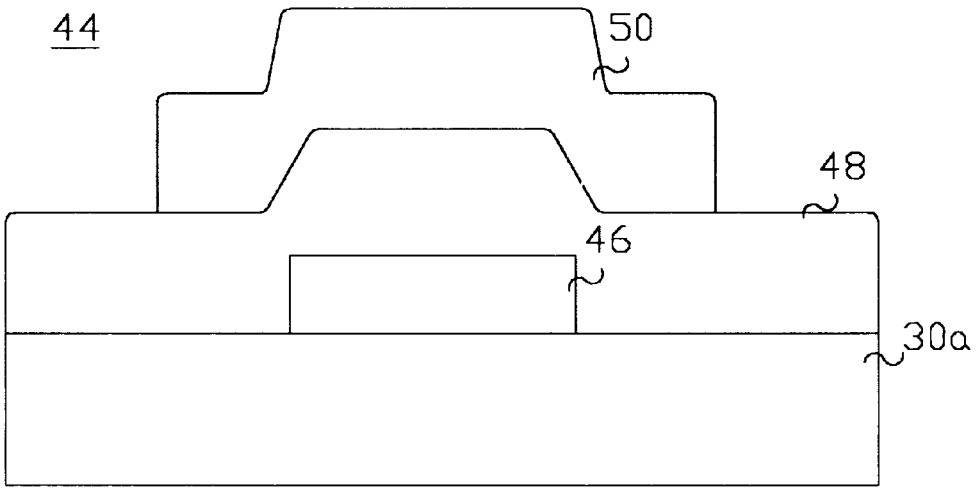
FIG. 3 is a sectional view representing a structure of the first preferred embodiment of the bypass capacitor shown in FIG. 2.

FIG. 3 is a sectional view representing a structure of the first preferred embodiment of a bypass capacitor 44 shown in FIG. 2. Referring now to FIG. 3, the bypass capacitor 44 preferably includes a first conductive layer pattern 46, a dielectric material film 48 and a second conductive layer pattern 50 disposed on the lower glass substrate 30*a* sequentially. The first conductive layer pattern 46 can be utilized as a ground line at which a noise and a ripple and other harmful effects arrive. The first conductive layer pattern 46 is preferably formed by defining a conductive material layer on the surface of the lower glass substrate 30*a* using a deposition process, and thereafter, by patterning the conductive material layer using the photolithography method. The dielectric material film 48 is formed by depositing dielectric material such as silicon nitride (SiNx) on the upper portion of the lower glass substrate 30*a*, on which the first conductive layer pattern 46 was defined, such that the film 48 has a uniform thickness. Next, in a manner similar to forming the first conductive layer pattern 46, the second conductive layer pattern 50 is formed by defining a conductive material layer on the surface of the dielectric material film 48 using the deposition process, and thereafter, by patterning the conductive material layer using the photolithography method. The second conductive layer pattern 50 formed in the above manner is used as the second signal wiring 42 shown in FIG. 2. Since the second conductive layer pattern 50 is used as the second signal wiring 42 in FIG. 2 as mentioned above, the bypass capacitor 44 is disposed between the lower glass substrate 30*a* and the second signal wiring 42. In fact, since the manufacturing processes of the first and second conductive layer patterns 46 and 50 and the dielectric material film is included in a portion of the manufacturing process of the thin film transistor, the bypass capacitor 44 is formed on the lower glass substrate 30*a* together with the formation of the thin film transistor.

Hereinafter, an area occupied by the bypass capacitor having a typical capacitance will be described in detail with reference to formulas and expressions to be given below.

Generally, a typical capacitance of a bypass capacitor provided in the LCD apparatus of preferred embodiments of the present invention has a value of hundreds of pF to hundreds of nF. This capacitance of the capacitor is determined by the thickness of the dielectric material film 48, the dielectric constant, and the overlapped area between the first and second conductive layer patterns 46 and 50, which can be expressed as the following formula:

$$C=\epsilon_0\epsilon_r \cdot A/d \tag{1}$$

in which C represents a capacitance of capacitor, $\epsilon_0$ and $\epsilon_r$ are dielectric constants, d is a thickness of the dielectric material film 48, and A is an overlapped area located between the first and second conductive layer patterns 46 and 50, respectively.

In order to make a capacitor having a capacitance value of 1 nF, it is assumed that a typical silicon nitride(SiNx), the thickness d of which is 4000 Å, was used as the dielectric material film. Herein, the dielectric constant $\epsilon_0\epsilon_r$ of the dielectric material film 48 has a value of about $6.78.85410^{-12}$ F/m. Applying the above numerical values to the formula (1), the area A of the bypass capacitor 44 is calculated by the following formula:

$$A = dc/\varepsilon_0\varepsilon_r \tag{2}$$

$$= (400010^{-10})(110^{-9})/6.78.85410^{-12}6.710^{-6}[\mathrm{m}]$$

As seen from the formula (2), the area A of the bypass capacitor 44 becomes a value of about 6.7 $mm^2$, so that the bypass capacitor 44 can be formed in such a manner to overlap with the second signal wiring 42 on the lower glass substrate 30*a*. Since the bypass capacitor 44 provided in the above manner has a sufficiently large capacitance value, it is usually used when any one of the first and second conductive layer patterns 46 and 50 is used as a line for transferring a direct current signal.

Figure 4:
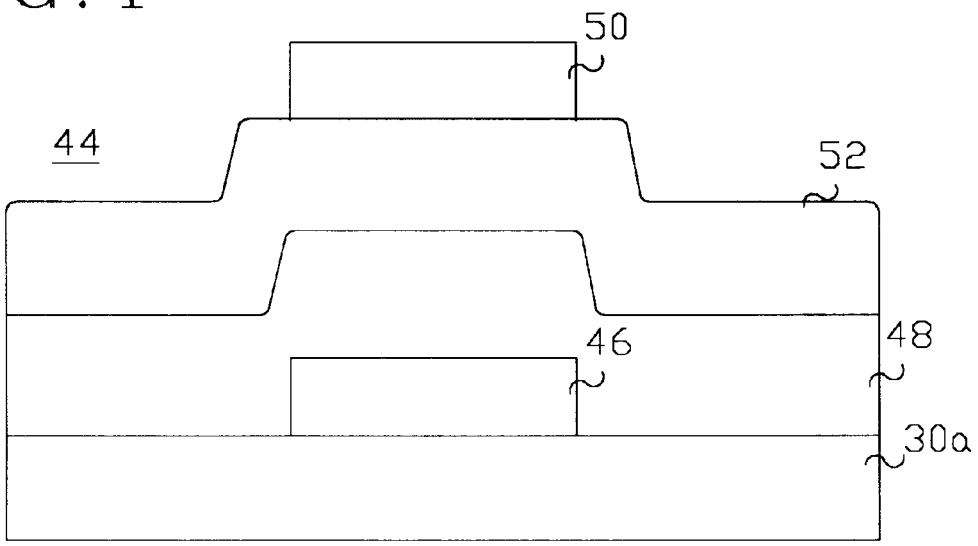
FIG. 4 is a sectional view representing a structure of a second preferred embodiment of the bypass capacitor shown in FIG. 2.

FIG. 4 is a sectional view representing a structure of the second preferred embodiment of the bypass capacitor shown in FIG. 2. Referring to FIG. 4, the bypass capacitor 44 includes a first conductive layer pattern 46, first and second dielectric material films 48 and 52 and a second conductive layer pattern 50 which are disposed on the lower glass substrate 30*a* sequentially. The first conductive layer pattern 46 can be utilized as a ground line at which a noise and a ripple and other harmful effects arrive. The first conductive layer pattern 46 is formed by defining a conductive material layer on the surface of the lower glass substrate 30*a* using the deposition process, and thereafter, by patterning the conductive material layer using the photolithography method. The first dielectric material film 48 is formed by depositing dielectric material such as silicon nitride (SiNx) on the upper portion of the lower glass substrate 30*a*, on which the first conductive layer pattern 46 was defined, so as to have a uniform thickness. Next, the second dielectric material film 52 is formed by depositing organic insulating material such as BCB on the upper portion of the first dielectric material film 48 so as to have a uniform thickness. Subsequently, in a manner similar to the forming of the first conductive layer pattern 46, the second conductive layer pattern 50 is formed by disposing a conductive material layer on the surface of the second dielectric material film 52 using the deposition process, and thereafter, by patterning the conductive material layer using the photolithography method. This second conductive layer pattern 50 is used as the second signal wiring 42 shown in FIG. 2. Since the second conductive layer pattern 50 is used as the second signal wiring 42 in FIG. 2 as mentioned above, the bypass capacitor 44 is disposed between the lower glass substrate 30*a* and the second signal wiring 42. In fact, since the manufacturing processes of the first and second conductive layer patterns 46 and 50 and the dielectric material film are involved in a part of the manufacturing process of thin film transistor, the bypass capacitor 44 is provided on the lower glass substrate 30*a* simultaneously with the thin film transistor.

The bypass capacitor as descried above has smaller capacitance value than the bypass capacitor in FIG. 3 because the dielectric material film is formed to have the two layer structure. Accordingly, the bypass capacitor having a configuration as shown in FIG. 4 can be utilized when a small capacitance value is required in accordance with characteristics of the video signal, the timing signal, and the power supply voltage signal supplied to the source driving IC chips. For example, when any one of the first and second conductive layer patterns 46 and 50 is used as a wiring for supplying a digital signal such as video signal, synchronous signal (or clock signal), etc., the bypass capacitor in FIG. 4 is preferably used to reduce a delay of the digital signal.

Figures 5A, 5B, 5C:
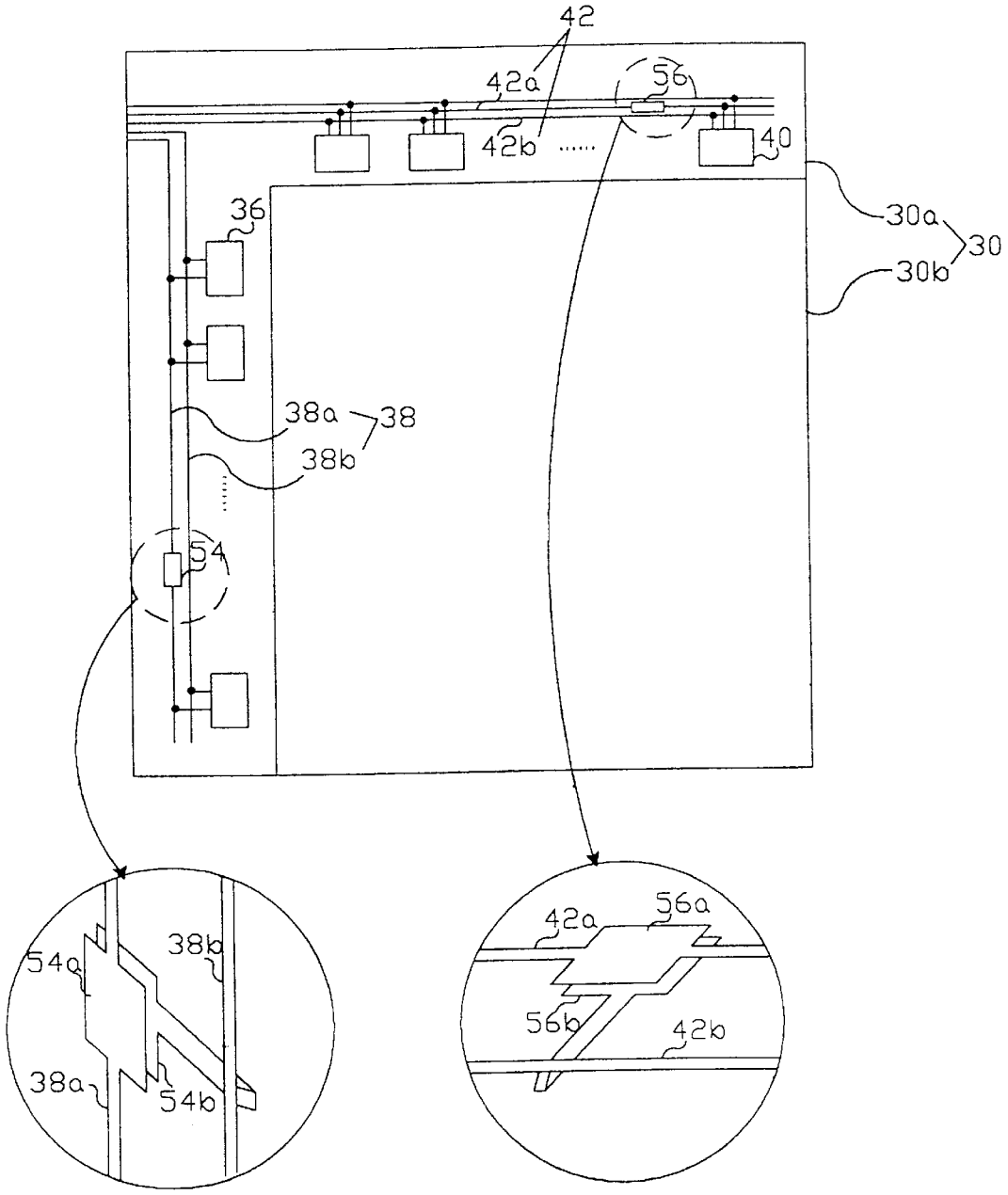
FIG. 5 is a schematic diagram showing a configuration of a liquid crystal panel having bypass capacitors arranged according to the second preferred embodiment of the present invention.

FIG. 5 schematically shows a layout of a liquid crystal panel mounted with bypass capacitors according to a second preferred embodiment of the present invention. Referring to FIG. 5, the liquid crystal panel 30 according to the second preferred embodiment of the present invention includes a lower glass substrate 30*a* and an upper glass substrate 30*b*. A liquid crystal cell matrix (not shown) in which liquid crystal cells are arranged in a matrix pattern along with thin film transistor, is provided between the glass substrates 30*a* and 30*b*. Gate driving IC chips 36 for divisionally driving gate lines of the liquid crystal cell matrix and a first signal wiring 38 for applying timing signals and power supply voltage signals to the gate driving IC chips 36 are disposed on the left side edge of the lower glass substrate 30*a*. Source driving IC chips 40 for divisionally driving source lines of the liquid crystal cell matrix and a second signal wiring 42 for applying video signals and timing signals to the source driving chips 40 are disposed on the upper edge of the lower glass substrate 30*a*. The first and second signal wirings 38 and 42 are electrically connected to the FPC 34 via connectors to thereby receive the video signals, the timing signals and the power supply voltage signals via the FPC 34 from the PCB 32.

Further, the liquid crystal panel 30 according to the second preferred embodiment of the present invention includes first bypass capacitors 54 that are formed to be electrically connected with first power supply voltage lines 38*a* and first ground voltage lines 38*b* in the first signal wiring 38, and second bypass capacitors 56 that are formed to be electrically connected with second power supply voltage lines 42*a* and second ground voltage lines in the second signal wiring 42. A digital voltage signal or an analog voltage signal can be transferred to the first power supply voltage line 38*a*, the first ground voltage line 38*b*, the second power supply voltage line 42*a* and the second ground voltage line 42*a*. The first bypass capacitor 54 includes a first conductive pad 54*a* that is located in the middle of the first power supply voltage line 38*a* or the first ground voltage line 38*b*, and a second conductive pad 54*b* that is disposed in the lower portion of the first conductive pad 54*a* and electrically connected to the first ground voltage line 38*b* or the first power supply voltage line 38*a*. A dielectric material film preferably made from silicon nitride is disposed between the first conductive pad 54*a* and the second conductive pad 54*b*. In other words, the first bypass capacitor 54 has a sectional structure as shown in FIG. 3.

Similar to the first bypass capacitor 54, the second bypass capacitor 56 includes a third conductive pad 56*a* that is preferably located in the middle of the second power supply voltage line 42*a* or the second ground voltage line 42*b*, a fourth conductive pad 56*b* that is disposed in the lower portion of the third conductive pad 56*a* and electrically connected to the second ground voltage line 42*b* or the second power supply voltage line 42*a*, and a dielectric material film disposed between the conductive pads 56*a* and 56*b*. In other words, the second bypass capacitor 56 has a sectional structure as shown in FIG. 3. In fact, since the manufacturing processes of the conductive pads 54*a*, 54*b*, 56*a* and 56*b* and the dielectric material film including the first and second bypass capacitors 54 and 56 are involved in a part of the manufacturing process of the thin film transistor, the first and second bypass capacitors 54 and 56 are formed on the lower glass substrate 30*a* simultaneously with the thin film transistor.

Figure 6:
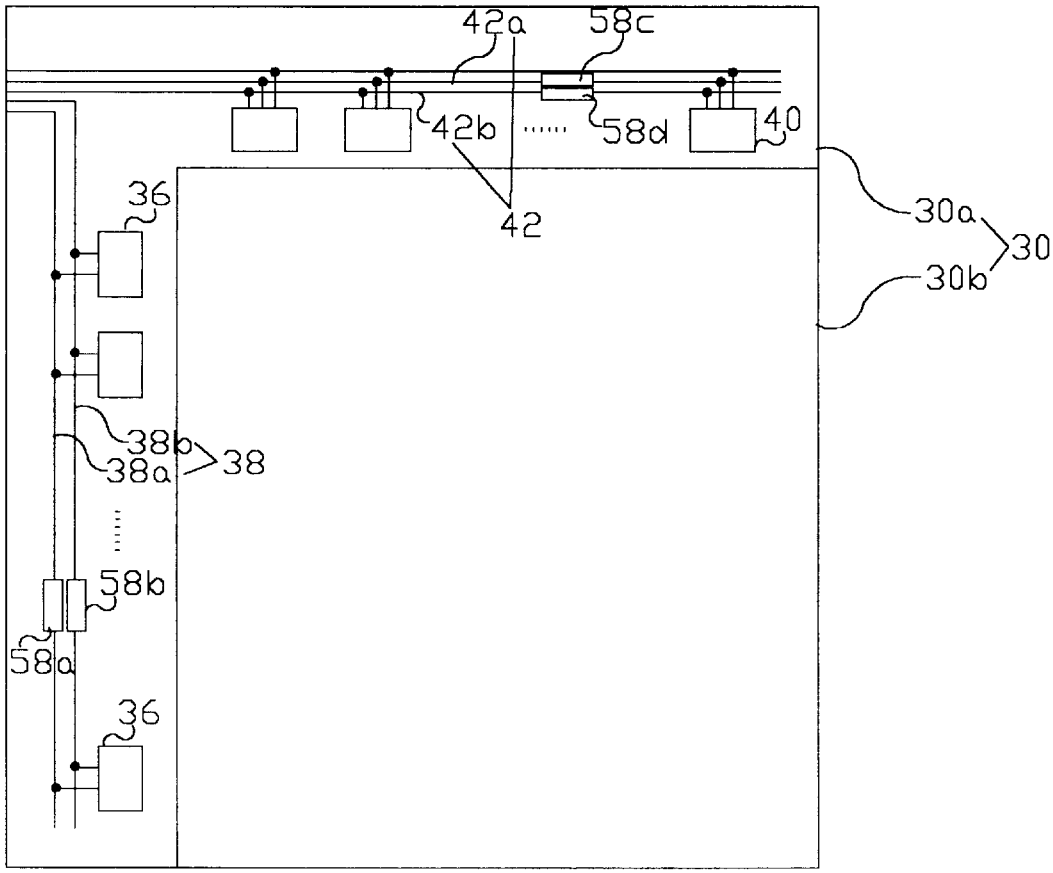
FIG. 6 is a schematic diagram showing a configuration of a liquid crystal panel having bypass capacitors arranged according to a third preferred embodiment of the present invention.

FIG. 6 schematically shows a layout of a liquid crystal panel mounted with bypass capacitors according to a third preferred embodiment of the present invention. Referring to FIG. 6, the liquid crystal panel 30 according to the third preferred embodiment of the present invention includes a lower glass substrate 30*a* and an upper glass substrate 30*b*. A liquid crystal cell matrix (not shown) in which liquid crystal cells are arranged in a matrix pattern along with the thin film transistor, is provided between the glass substrates 30*a* and 30*b*. Gate driving IC chips 36 for divisionally driving gate lines of the liquid crystal cell matrix and a first signal wiring 38 for applying timing signals and power supply voltage signals to the gate driving IC chips 36 are disposed on the left side edge of the lower glass substrate 30*a*. Source driving IC chips 40 for divisionally driving source lines of the liquid crystal cell matrix and a second signal wiring 42 for applying video signals and timing signals to the source driving chips 40 are disposed on the upper edge of the lower glass substrate 30*a*. The first and second signal wirings 38 and 42 are electrically connected to the FPC 34 by means of connectors to thereby receive the video signals, the timing signals and the power supply voltage signals via the FPC 34 from the PCB 32.

Further, the liquid crystal panel 30 according to the third preferred embodiment of the present invention includes first and second conductive pads 58*a* and 58*b* provided on first power supply voltage lines 38*a* and first ground voltage lines 38*b* in the first signal wiring 38, respectively, and third and fourth conductive pads 58*c* and 58*d* provided on second power supply voltage lines 42*a* and second ground voltage lines 42*b* in the second signal wiring 42, respectively. Chip bypass capacitors are connected to the first and second conductive pads 58*a* and 58*b*, and the third and fourth conductive pads 58*c* and 58*d*, respectively. Each of the first to fourth conductive pads 58*a*, 58*b*, 58*c* and 58*d* preferably has the area of "0.5 mm×0.5 mm" to "1 mm×1 mm" which is sufficient to connect chip bypass capacitors which have the size of 1608 or 1005 each. Likewise, the first to fourth conductive pads 58*a* to 58*d* are formed simultaneously with thin film transistors.

Figure 7:
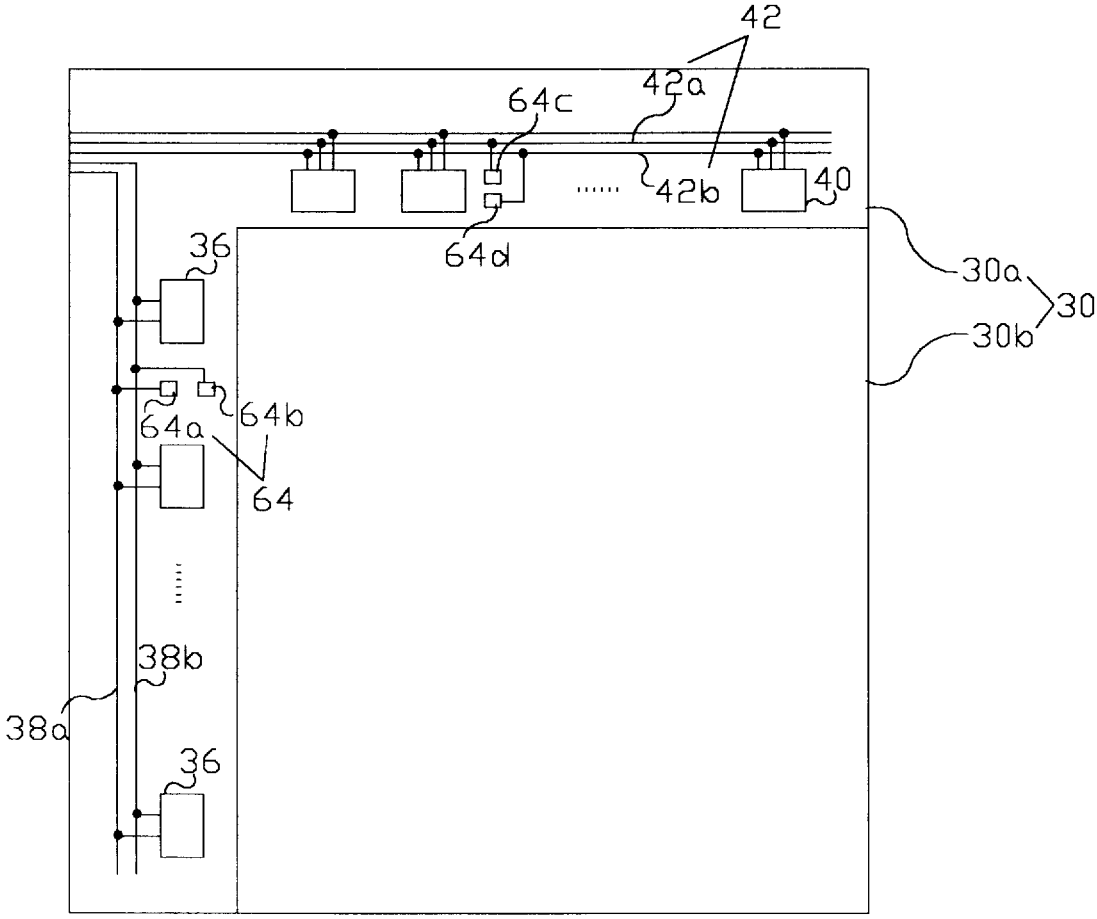
FIG. 7 is a schematic diagram showing a configuration of a liquid crystal panel having bypass capacitors arranged according to a fourth preferred embodiment of the present invention.

FIG. 7 schematically shows a layout of a liquid crystal panel including bypass capacitors according to a fourth preferred embodiment of the present invention. Referring to FIG. 7, the liquid crystal panel 30 according to the fourth preferred embodiment of the present invention includes a lower glass substrate 30*a* and an upper glass substrate 30*b*. A liquid crystal cell matrix (not shown) in which liquid crystal cells are arranged in a matrix pattern along with the thin film transistor, is provided between the glass substrates 30*a* and 30*b*. Gate driving IC chips 36 for divisionally driving gate lines of the liquid crystal cell matrix and a first signal wiring 38 for applying timing signals and power supply voltage signals to the gate driving IC chips 36 are disposed on the left side edge of the lower glass substrate 30*a*. Source driving IC chips 40 for divisionally driving source lines of the liquid crystal cell matrix and a second signal wiring 42 for applying video signals and timing signals to the source driving chips 40 are disposed on the upper edge of the lower glass substrate 30*a*. The first and second signal wirings 38 and 42 are electrically connected to the FPC 34 via connectors to thereby receive the video signals, the timing signals and the power supply voltage signals via the FPC 34 from the PCB 32.

Further, the liquid crystal panel 30 according to the fourth preferred embodiment of the present invention includes first and second conductive pads 64*a* and 64*b* that are electrically connected to first power supply voltage lines 38*a* and first ground voltage lines 38*b* in the first signal wiring 38, respectively, and arranged in parallel between gate driving IC chips 36, and third and fourth conductive pads 58*c* and 58*d* that are electrically connected to second power supply voltage lines 42*a* and second ground voltage lines 42*b* in the second signal wiring 42, respectively and arranged in parallel between source driving IC chips 40.

Chip bypass capacitors are connected to the first and second conductive pads 58*a* and 58*b*, and the third and fourth conductive pads 58*c* and 58*d*, respectively. Each of the first to fourth conductive pads 58*a*, 58*b*, 58*c* and 58*d* has the area of "0.5 mm×0.5 mm" to "1 mm×1 mm" which is sufficient to connect chip bypass capacitors which have the size of 1608 or 1005 each. Likewise, the first to fourth conductive pads 58*a* to 58*d* are formed simultaneously with thin film transistors.

As described above, a liquid crystal panel according to preferred embodiments of the present invention includes bypass capacitors which are mounted on a lower portion of the wiring in the liquid crystal panel, so that the bypass capacitors can remove a noise and a ripple and other harmful effects included in an electrical signal applied to driving IC chips while also still being able to provide a liquid crystal panel having a greatly reduced thickness. Also, in a liquid crystal panel according to preferred embodiments of the present invention, the bypass capacitors are manufactured during the manufacturing process of thin film transistor. Therefore, the liquid crystal panel does not require any additional manufacturing processes for the formation of capacitors.

Further, a liquid crystal panel according to the present invention can mount the bypass capacitors in such a manner to be connected each of electrode pads by providing the wiring and the electrode pads connected to the wiring. Since these electrode pads are formed by the partial fabrication process of thin film transistors, the liquid crystal panel does not require any additional manufacturing steps or processes.

Moreover, according to preferred embodiments of the present invention, the liquid crystal display apparatus mounts bypass capacitors on the liquid crystal panel, so that the liquid crystal panel has a greatly reduced thickness compared to prior art devices having bypass capacitors and a manufacturing process for forming the bypass capacitors is greatly simplified. Also, the liquid crystal display apparatus removes a noise and a ripple, etc. using the bypass capacitors, so that it can not only maintain a stable power supply voltage, but can display a high quality picture.

Although the present invention has been explained by preferred embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal panel comprising:

a first glass substrate defining an upper substrate;

a second glass substrate defining a lower substrate;

a liquid crystal cell matrix having thin film transistors and liquid crystal cells between the upper substrate and the lower substrate;

a plurality of signal lines provided on one of said first and second glass substrates for receiving signals from an exterior thereof and for transferring the signals to said liquid crystal cell matrix; and at least one bypass capacitor arranged to remove noise components included in signals to be transferred through each of said signal lines, said at least one bypass capacitor being located on an upper surface of the lower substrate and arranged to overlap at least one of said signal lines such that the at least one bypass capacitor is electrically connected to said at least one of said signal lines, the at least one bypass capacitor overlapping said at least one of said signal lines at a location that is spaced apart from a flexible printed circuit film.

2. The liquid crystal panel according to claim 1, further comprising a plurality of driving integrated circuit (IC) chips provided on the upper surface of the lower substrate and arranged such that the at least one bypass capacitor overlaps said signal lines at a location between adjacent ones of the driving IC chips.

3. The liquid crystal panel according to claim 2, wherein the driving IC chips include gate driving IC chips and source driving IC chips, the liquid crystal panel further comprising a plurality of bypass capacitors, each of the plurality of bypass capacitors overlapping said signal lines at locations that are between adjacent ones of the gate driving IC chips and source driving IC chips and that are spaced apart from the flexible printed circuit film.

4. The liquid crystal panel according to claim 1, further comprising a plurality of bypass capacitors, each of the plurality of bypass capacitors overlapping one of said signal lines at a location that is spaced apart from a flexible printed circuit film.

5. The liquid crystal panel according to claim 1, wherein said signal lines comprise power supply voltage lines and ground voltage lines, and are arranged to receive power supply voltage signals from an exterior; and further comprising a plurality of bypass capacitors arranged to remove noise components included in the power supply voltage signals to be transferred through said power supply voltage lines and said ground voltage lines, each of said bypass capacitors overlapping one of said power supply lines or one of said ground voltage lines in such a manner to be electrically connected to said one of said power supply voltage lines and said ground voltage lines.

6. The liquid crystal panel according to claim 1, further comprising:

a plurality of electrode pads arranged to define a capacitor and being located on said upper surface of said lower substrate and electrically connected to one of said signal lines; and a plurality of bypass capacitors connected to one of said electrode pads for removing noise components included in the signals to be transferred through each of said signal lines.

7. The liquid crystal panel according to claim 6, wherein said signal lines comprise power supply voltage lines and ground voltage lines and are arranged to receive power supply voltage signals from an exterior and each of said bypass capacitors overlapping one of said power supply lines or one of said ground voltage lines in such a manner to be electrically connected to said one of said power supply voltage lines and said ground voltage lines.

8. A liquid crystal display apparatus, comprising:

a first glass substrate defining an upper substrate;

a second glass substrate defining a lower substrate;

a liquid crystal panel having a liquid crystal cell matrix defined by thin film transistors and liquid crystal cells located between the upper substrate and the lower substrate;

a plurality of matrix driving integrated circuits mounted on said liquid crystal panel;

an electrical signal converter for producing video signals and timing signals that are required for said matrix driving integrated circuits;

a plurality of signal lines provided on one of said first and second glass substrates for receiving signals from an exterior thereof and for transferring the signals to said matrix driving integrated circuits;

at least one flexible printed circuit film for connecting said electrical signal converter to said signal lines; and at least one bypass capacitor arranged to remove noise components included in signals to be transferred through each of said signal lines, said at least one bypass capacitor being located on an upper surface of the lower substrate and arranged to overlap at least one of said signal lines such that the at least one bypass capacitor is electrically connected to said at least one of said signal lines, the at least one bypass capacitor overlapping said at least one of said signal lines at a location that is spaced apart from a flexible printed circuit film.

9. The liquid crystal display apparatus according to claim 8, further comprising a plurality of driving integrated circuit (IC) chips provided on the upper surface of the lower substrate and arranged such that the at least one bypass capacitor overlaps said signal lines at a location between adjacent ones of the driving IC chips.

10. The liquid crystal display apparatus according to claim 9, wherein the driving IC chips include gate driving IC chips and source driving IC chips, the liquid crystal panel further comprising a plurality of bypass capacitors, each of the plurality of bypass capacitors overlapping said signal lines at locations that are between adjacent ones of the gate driving IC chips and source driving IC chips and that are spaced apart from a flexible printed circuit film.

11. The liquid crystal display apparatus according to claim 8, further comprising a plurality of bypass capacitors, each of the plurality of bypass capacitors overlapping one of said signal lines at a location that is spaced apart from a flexible printed circuit film.

12. The liquid crystal display apparatus according to claim 8, wherein said signal lines comprise power supply voltage lines and ground voltage lines and are arranged to receive power supply voltage signals from an exterior; and further comprising a plurality of bypass capacitors arranged to remove noise components included in the power supply voltage signals to be transferred through said power supply voltage lines and said ground voltage lines, each of said bypass capacitors overlapping one of said power supply lines or one of said ground voltage lines in such a manner to be electrically connected to said one of said power supply voltage lines and said ground voltage lines.

13. The liquid crystal display apparatus according to claim 8, further comprising:

a plurality of electrode pads arranged to define a capacitor and being located on said upper surface of said lower substrate and electrically connected to one of said signal lines; and a plurality of bypass capacitors connected to one of said electrode pads for removing noise components included in the signals to be transferred through each of said signal lines.

14. The liquid crystal display apparatus according to claim 13, wherein said signal lines comprise power supply voltage lines and ground voltage lines and are arranged to receive power supply voltage signals from an exterior and each of said bypass capacitors overlapping one of said power supply lines or one of said ground voltage lines in such a manner to be electrically connected to said one of said power supply voltage lines and said ground voltage lines.

15. A liquid crystal panel comprising:

a first glass substrate defining an upper substrate;

a second glass substrate defining a lower substrate;

a liquid crystal cell matrix having thin film transistors and liquid crystal cells between the upper substrate and the lower substrate;

a plurality of signal lines provided on one of said first and second glass substrates for receiving signals from an exterior thereof and for transferring the signals to said liquid crystal cell matrix; and at least one bypass capacitor arranged to remove noise components included in signals to be transferred through each of said signal lines, said at least one bypass capacitor being located between an upper surface of the lower substrate and said signal lines at a location that is spaced apart from a flexible printed circuit film such that the at least one bypass capacitor is electrically connected to at least one of said signal lines.

16. The liquid crystal panel according to claim 15, further comprising a plurality of driving integrated circuit (IC) chips provided on the upper surface of the lower substrate and arranged such that the at least one bypass capacitor overlaps said signal lines at a location between adjacent ones of the driving IC chips.

17. The liquid crystal panel according to claim 16, wherein the driving IC chips include gate driving IC chips and source driving IC chips, the liquid crystal panel further comprising a plurality of bypass capacitors, each of the plurality of bypass capacitors overlapping said signal lines at locations that are between adjacent ones of the gate driving IC chips and source driving IC chips and that are spaced apart from a flexible printed circuit film.

18. The liquid crystal panel according to claim 15, further comprising a plurality of bypass capacitors, each of the plurality of bypass capacitors overlapping one of said signal lines at a location that is spaced apart from a flexible printed circuit film.

19. The liquid crystal panel according to claim 15, wherein said signal lines comprise power supply voltage lines and ground voltage lines and are arranged to receive power supply voltage signals from an exterior; and further comprising a plurality of bypass capacitors arranged to remove noise components included in the power supply voltage signals to be transferred through said power supply voltage lines and said ground voltage lines, each of said bypass capacitors overlapping one of said power supply lines or one of said ground voltage lines in such a manner to be electrically connected to said one of said power supply voltage lines and said ground voltage lines.

20. The liquid crystal panel according to claim 15, further comprising:

a plurality of electrode pads arranged to define a capacitor and being located on said upper surface of said lower substrate and electrically connected to one of said signal lines; and a plurality of bypass capacitors connected to one of said electrode pads for removing noise components included in the signals to be transferred through each of said signal lines.

21. The liquid crystal panel according to claim 20, wherein said signal lines comprise power supply voltage lines and ground voltage lines and are arranged to receive power supply voltage signals from an exterior and each of said bypass capacitors overlapping one of said power supply lines or one of said ground voltage lines in such a manner to be electrically connected to said one of said power supply voltage lines and said ground voltage lines.

* * * * *